US006216964B1

(12) United States Patent
Lambert

(10) Patent No.: US 6,216,964 B1
(45) Date of Patent: Apr. 17, 2001

(54) FUEL INJECTOR

(75) Inventor: Malcolm David Dick Lambert, Bromley (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/346,513

(22) Filed: Jul. 1, 1999

(30) Foreign Application Priority Data

Jul. 17, 1998 (GB) ..... 9815654

(51) Int. Cl.[7] ..... F02M 61/00
(52) U.S. Cl. ..... 239/533.12; 239/584; 251/129.06
(58) Field of Search ..... 239/533.1, 533.2, 239/533.3, 533.12, 533.7, 533.9, 583, 584, 463, 490, 499, 504, 518, 102.1, 102.2; 251/129.06, 129.11, 266

(56) References Cited

U.S. PATENT DOCUMENTS 2,096,581 10/1937 Goldberg ..... 299/107.6
4,382,553 5/1983 Thoma et al. ..... 239/533.9
5,755,385 * 5/1998 Potz et al. ..... 239/533.2
5,899,385 * 5/1999 Hofmann et al. ..... 239/533.2
6,085,726 * 7/2000 Lei et al. ..... 239/463

FOREIGN PATENT DOCUMENTS 2314119 12/1997 (GB) .

* cited by examiner

*Primary Examiner*—Lisa Ann Douglas
(74) *Attorney, Agent, or Firm*—Wells, St. John, Roberts, Gregory & Matkin, P.S.

(57) ABSTRACT

A fuel injector comprising a valve needle slidable within a bore formed in a nozzle body, the valve needle including an axially extending fuel supply passage which communicates with at least one outlet opening provided in the valve needle, the end of the supply passage adjacent the at least one outlet opening being closed by a plug. The plug has an inner end region which is arranged to be located, in use, adjacent the, or at least one of the, outlet openings, and shaped to modify the flow characteristics of the fuel flow upstream of at least one of the outlet openings.

11 Claims, 4 Drawing Sheets

FIG 3
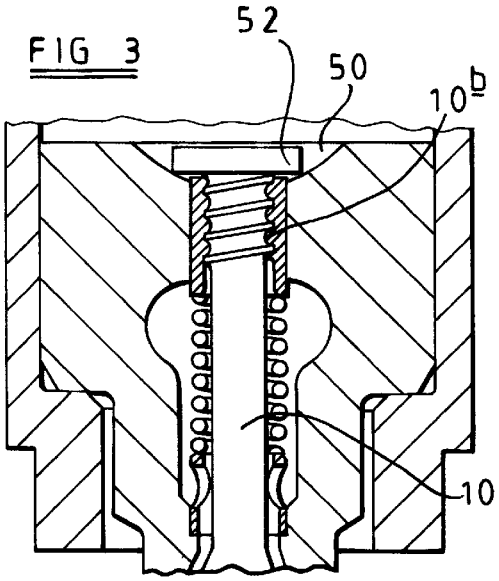
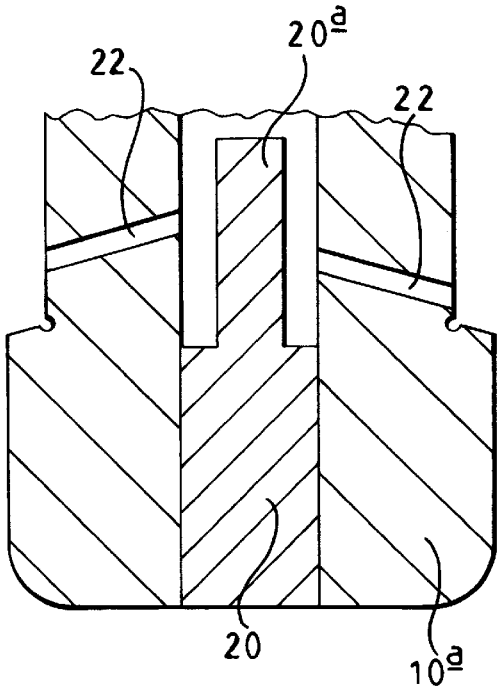
FIG 4a
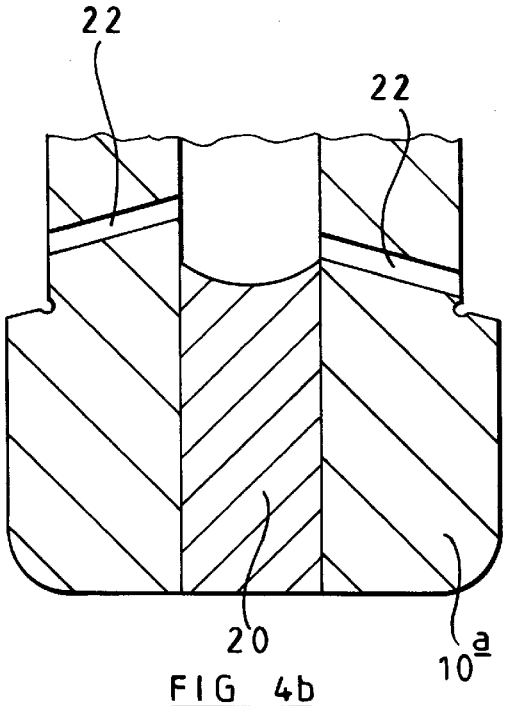
FIG 4b
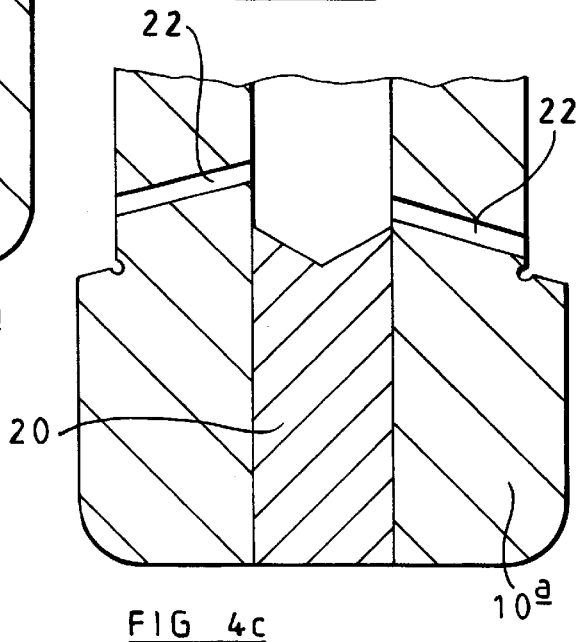
FIG 4c

FIG 4d
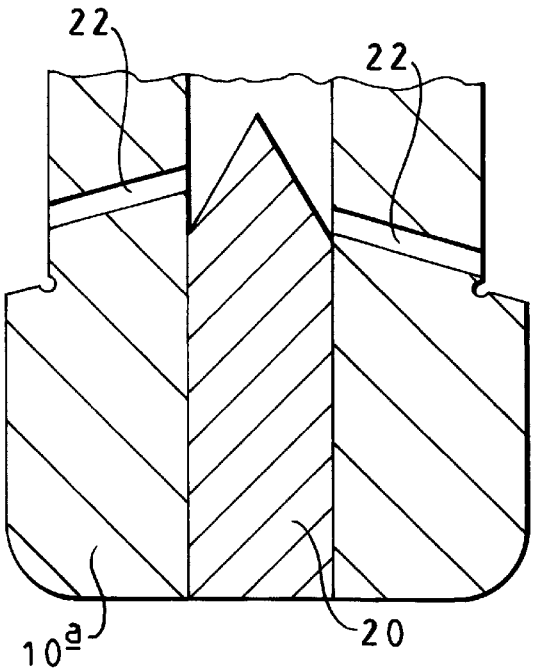
FIG 5b
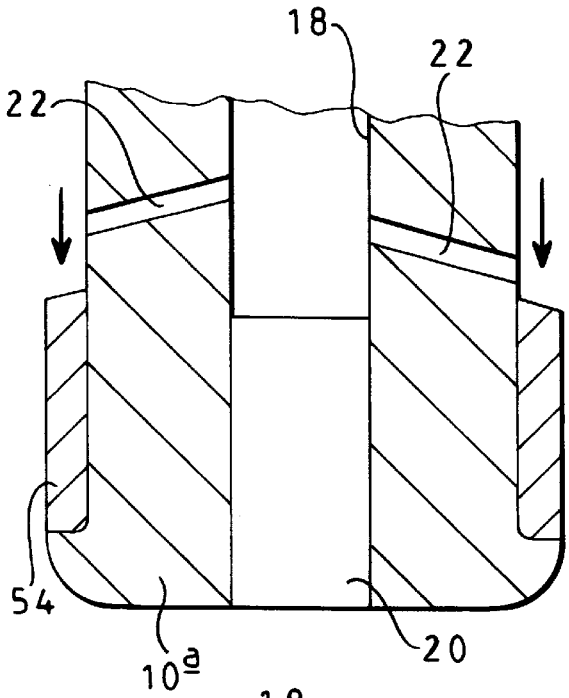
FIG 5a
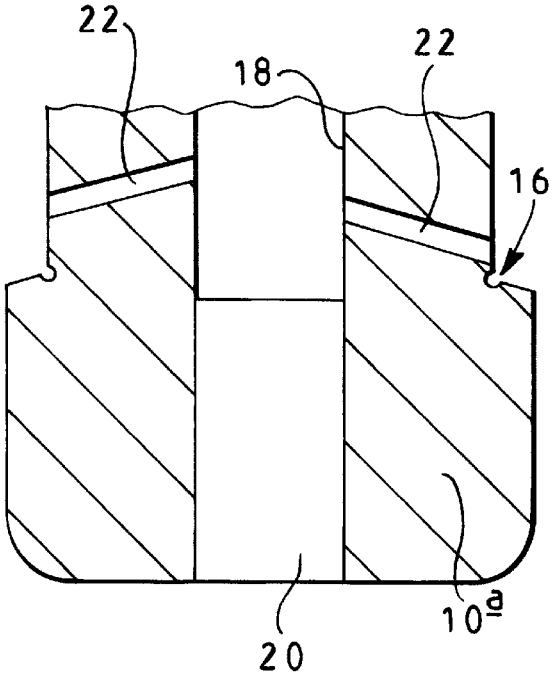
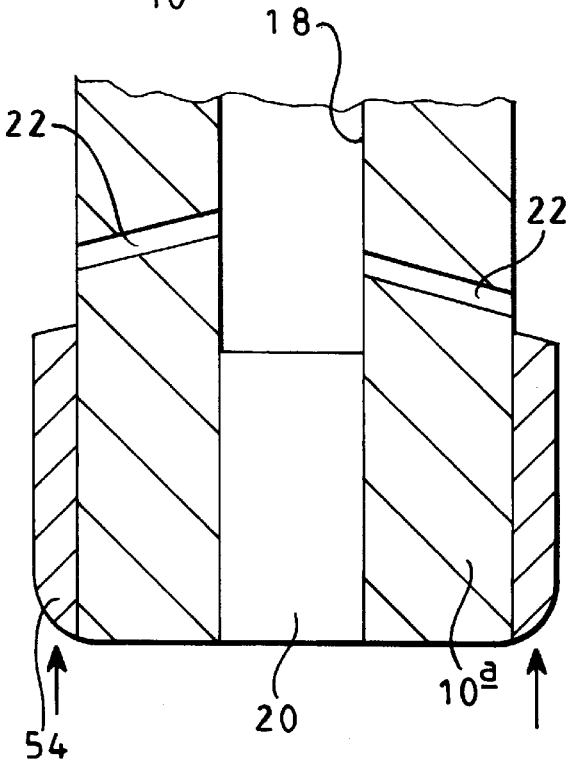
FIG 5c

FUEL INJECTOR

BACKGROUND OF THE INVENTION

This invention relates to an injector for use in supplying fuel to a combustion space of an internal combustion engine. The invention relates, in particular, to an injector of the outwardly opening type suitable for use in supplying fuel to an engine of the compression ignition type.

Part of a typical injector of the outwardly opening type is illustrated in FIG. 1. As shown in FIG. 1, the injector comprises a needle 1 slidable within a bore 2 formed in a nozzle body 3. The bore 2 defines a seating with which the needle 1 is engageable to control the supply of fuel to a chamber 4. The position of the needle 1 also determines how many of a plurality of outlet openings 5 communicate with the chamber 4.

Part of the needle 1 downstream of the seating is of diameter substantially equal to the adjacent part of the bore 2 and engagement therebetween guides movement of the needle 1. It has been found, however, that fuel may leak between this part of the needle 1 and the bore resulting in inefficient combustion of fuel and high levels of emissions. Where the injector is used with a fuel system of the direct injection type, the level of leakage may be increased due to dilation of the bore 2.

SUMMARY OF THE INVENTION

The disadvantage described hereinbefore can be reduced by increasing the axial length of the region of the needle which engages the bore to guide the movement of the needle, and this can be achieved by providing the needle with a fuel supply passage which communicates with one or more outlet openings provided in the needle rather than in the nozzle body. However, by providing the outlet openings in the needle rather than the nozzle body, angular movement of the needle, in use, may result in the delivery of fuel being incorrectly orientated where the fuel injector is not mounted vertically.

According to a first aspect of the invention there is provided an injector comprising a valve needle slidable within a bore formed in a nozzle body, the valve needle including an axially extending fuel supply passage which communicates with at least one outlet opening provided in the needle, wherein the end of the supply passage adjacent the outlet opening is closed by a plug, the plug having an inner end region which is arranged to be located, in use, adjacent the, or at least one of the, outlet openings and shaped to modify the flow characteristics of the fuel flow upstream of at least one of the said outlet openings.

The plug may, for example, be shaped to define a recess, for example of conical or part spherical form, or may include a projection of, for example, cylindrical or conical form. The inner end region of the plug may be shaped to generate cavitation upstream the outlet openings, or may increase or decrease other hydraulic disturbances upstream of the outlet openings.

The fuel injector may further comprise lock means arranged to restrict angular movement of the needle about the axis of the needle relative to the nozzle body.

The lock means conveniently comprises a lock member extending within formations provided in the valve needle and the nozzle body. The lock member may take the form of a pin, and the formations may define a groove or slot in the upper end surface of the valve needle and a groove or recess formed in the upper surface of the nozzle body.

The injector in accordance with this embodiment of the invention is advantageous in that as angular movement of the needle is restricted, if the needle includes one or more outlet openings, the orientation of fuel sprays formed at the outlet openings, in use, remain fixed.

The valve needle may carry an annular abutment member which is engageable with the seating to control the flow of fuel past the seating.

The abutment member may be an interference fit or may be secured to the valve needle by, for example, welding or brazing.

The use of an abutment member carried by the valve needle simplifies manufacture of the valve needle.

According to a second aspect of the invention there is provided a fuel injector comprising a valve needle slidable within a bore formed in a nozzle body, and lock means arranged to restrict angular movement of the needle about the axis of the needle relative to the nozzle body.

According to a third aspect of the invention there is provided a fuel injector of the outwardly opening type comprising a valve needle slidable within a bore provided in a nozzle body, the bore defining a valve seating, the valve needle carrying an annular abutment member which is engageable with the seating to control the flow of fuel past the seating.

According to another aspect of the invention there is provided a fuel injector comprising a valve needle slidable within a bore formed in a nozzle body, wherein the diameters of the needle, the bore and the outer periphery of the nozzle body are chosen to optimize stress levels within the nozzle body and the needle, thereby restricting the leakage of fuel between the needle and the nozzle body to an acceptable level.

BRIEF DESCRIPTION OF THE VIEWS OF THE DRAWINGS

The invention will further be described, by way of example, with reference to the accompanying drawings, in which:

FIG. 3 is a sectional view along the line 3—3 in FIG. 2;

FIGS. 4*a*, 4*b*, 4*c* and 4*d* illustrate modifications to the embodiment of FIG. 2;

FIG. 5*a* is an enlarged view of part of the injector of FIG. 2; and

FIGS. 5*b* and 5*c* are views similar to FIG. 5*a* illustrating modifications thereto.

DETAILED DESCRIPTION OF THE PREFERRED EMBODIMENTS

Figure 1:
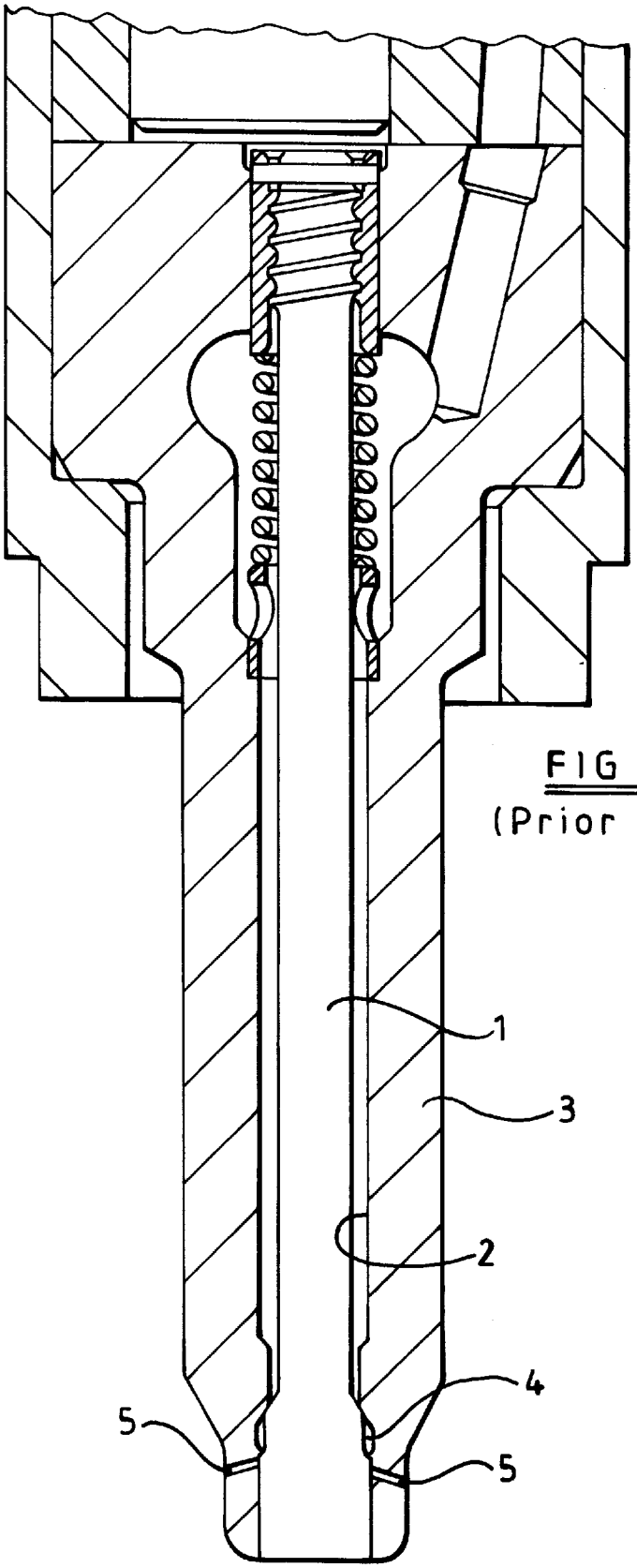
FIG 1 (Prior art)
FIG. 1 is a sectional view illustrating part of a typical injector.
Figure 2:
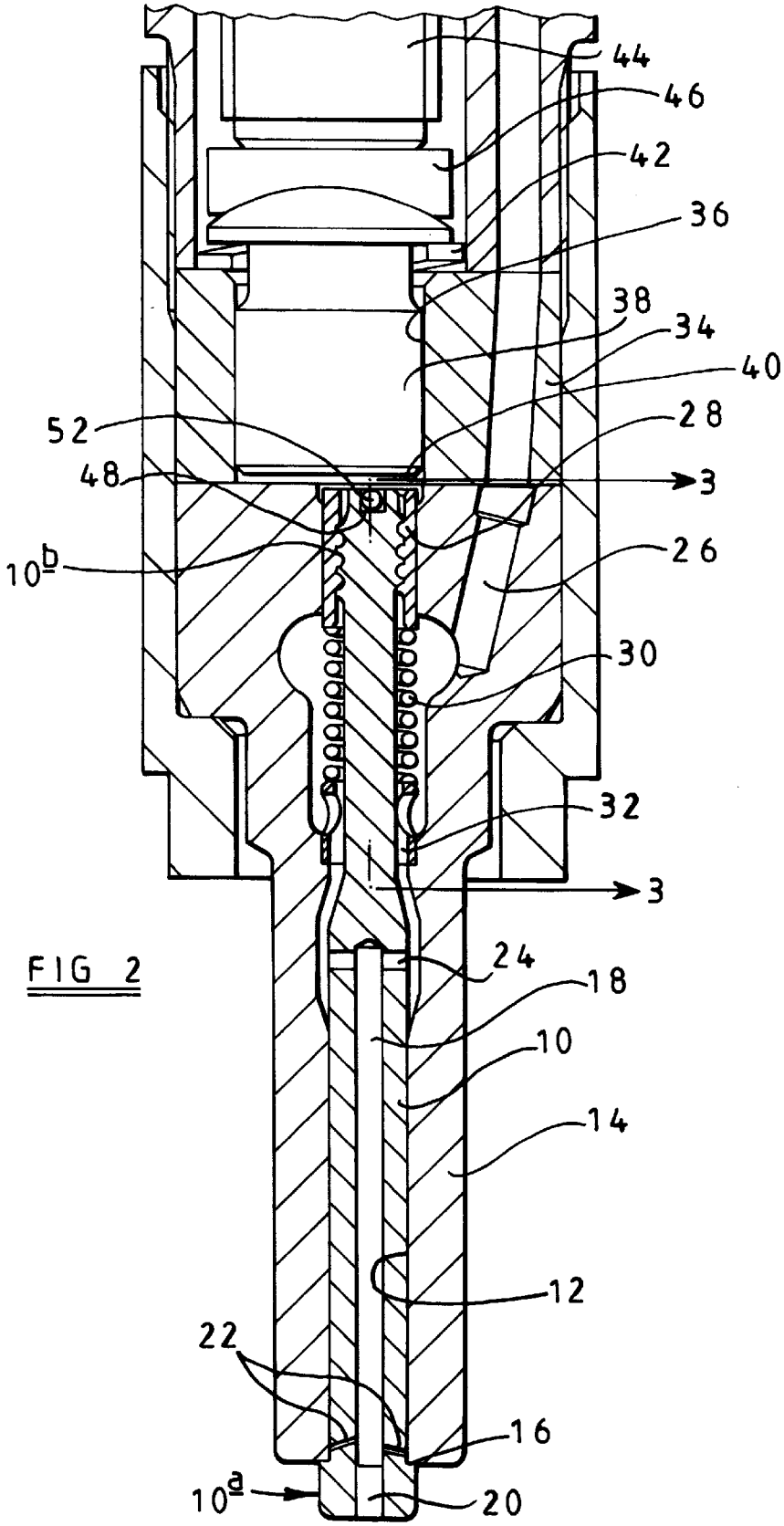
FIG. 2 is a sectional view illustrating part of an injector in accordance with an embodiment of the invention.

The fuel injector illustrated, in part, in FIGS. 2 and 3 comprises a valve needle 10 which is slidable within a bore 12 formed in a nozzle body 14. The bore 12 is a through bore, and defines, at its lower end, a seating 16 with which an enlarged diameter region 10*a* of the valve needle 10 is engageable. A significant portion of the bore 12 upstream of the seating 16 is of diameter substantially equal to the diameter of the adjacent part of the needle 10, engagement between the needle 10 and the wall of the nozzle body 14 defining this part of the bore 12 acting to guide sliding movement of the needle 10 within the bore 12. The diameters of the needle 10, the bore 12 and the outer periphery of the nozzle body 14 are chosen to optimize stress levels and minimize leakage of fuel between the needle 10 and the nozzle body 14 whilst providing a sufficient clearance to permit lubrication and free movement of the needle 10.

The needle 10 is provided with an axially extending, blind drilling 18, the lower end of which is closed by means of a plug 20 which may be brazed in position or may, for example, comprise a grub screw. The drilling 18 communicates with a plurality of outlet openings 22 which are located such that when the needle 10 engages the seating 16, the outlet openings 22 are obscured by the adjacent parts of the nozzle body 14. Movement of the valve needle 10 in the opening direction moves the enlarged region 10*a* of the valve needle 10 away from the seating 16, further movement resulting in one or more of the outlet openings 22 occupying a position in which it is no longer obscured by the nozzle body 14. The outlet openings 22 may, as illustrated, be located at different axial positions and may point in different directions, particularly where the injector is to be mounted in a non-vertical orientation. The openings 22 may be of non-circular cross-sectional shape, if desired.

Adjacent its blind end, the drilling 18 communicates with a plurality of cross drillings 24 to permit communication between the bore 12 and the drilling 18. The cross drillings 24 may be spaced apart in the axial direction, if desired. In use, the bore 12 is supplied with fuel under high pressure from an appropriate source of fuel under pressure, for example a common rail charged with fuel to a high pressure by an appropriate fuel pump through a supply drilling 26 provided in the nozzle body 14.

The end of the needle 10 remote from the enlarged diameter region 10*a* thereof is provided with an external screw-thread formation 10*b* of large root radius and external diameter which engages an annular guide member 28 of external diameter substantially equal to the diameter of the adjacent part of the bore 12, the guide member 28 further assisting in guiding sliding movement of the needle 10 within the bore 12. The use of the illustrated screw thread formation is advantageous in that the leakage of fuel between the needle and guide member can be reduced. It will be appreciated that, if desired, a conventional screw thread formation may be provided. A spring 30 engages the guide member 28, the spring 30 being in engagement with a spring abutment member 32 located within the bore 12, the spring 30 acting to bias the valve needle 10 in a closing direction towards a position in which the enlarged diameter region 10*a* thereof engages the seating 16. As illustrated, the spring abutment member 32 is provided with a plurality of openings to ensure that the flow of fuel along the bore 12 is not impeded to a significant extent by the presence of the spring abutment member 32.

The end of the nozzle body 10 remote from the seating 16 engages a distance piece 34 which is provided with a drilling which communicates with the supply drilling 26. The distance piece 34 includes a through bore 36 which is offset from the axis of the distance piece 34, and within which a piston member 38 is slidable. The piston member 38, the bore 36, the upper part of the bore 12 and the upper surfaces of the needle 10 and guide member 28 together define a control chamber 40, the fuel pressure within which applies a force to the needle 10 urging the needle 10 in an opening direction against the action of the spring 30.

The piston member 38 is biased by an appropriate spring 42 in a direction urging the piston member 38 away from the nozzle body 10. A piezoelectric actuator 44 is arranged such that energization thereof can apply a force to the piston member 38 through an appropriate anvil member 46, if desired, to move the piston member 38 and hence vary the fuel pressure present within the control chamber 40.

The end surface of the valve needle 10 remote from the enlarged diameter region 10*a* thereof is provided with a diametrically extending groove or slot 48, and the adjacent parts of the guide member 28 are provided with recesses which, in use, effectively act as extensions of the slot 48. A recess 50 is formed in the surface of the nozzle body 14 adjacent the distance piece 34, for example using a Woodruff cutter. A pin 52 is located within the slot 48, the ends of the pin 52 extending into the recess 50. It will be appreciated that the engagement between the pin 52 and the walls defining the slot 48 and the recess 50 acts to restrict angular motion of the needle 10 relative to the nozzle body 14, thus ensuring that the orientation of the outlet openings 22 relative to the nozzle body 14 does not change, in use. The engagement of the pin 52 within the slot 48 and the recesses formed in the guide member 28 further ensure that undesirable release of the guide member 28 from the needle 10 does not occur. The dimensions of the slot 48, the recesses provided in the guide member 28 and the recess 50 are chosen to ensure that axial sliding movement of the needle 10, in use, is not impeded.

Rather than using the pin 52 to avoid release of the guide member 28 from the needle 10, a lock nut or weld may be used to avoid such release, or the guide member may simply be welded to the needle, the screw thread formations being omitted. In such arrangements, the pin 52 functions only to restrict angular movement of the needle 10 relative to the nozzle body 14.

In use, with fuel supplied under pressure to the bore 12 through the supply drilling 26, and with the actuator 44 occupying an energization state in which the piston member 38 is permitted to occupy a position in which the fuel pressure within the control chamber 40 is relatively low, the valve needle 10 is urged by the spring 30 and by the fuel pressure within the bore 12 to occupy a position in which the enlarged diameter region 10*a* thereof engages the seating 16. The guide member 28 is conveniently of diameter such that the fuel pressure within the bore 12 applies a force to the needle 10 assisting the spring 30. Clearly, in this position, injection of fuel does not take place.

In order to commence injection, the actuator 44 is energized to move the piston 38 against the action of the spring 42, thereby increasing the fuel pressure present within the control chamber 40. The piston member 38 is conveniently of relatively large diameter, a relatively small movement thereof being sufficient to vary the pressure within the control chamber 40 by an extent sufficient to control operation of the injector. As only a small degree of movement of the piston member 38 is required, it will be appreciated that the actuator 44 may be relatively small. Such an increase in fuel pressure increases the force applied to the valve needle 10 acting in the opening direction, and a point will be reached beyond which the fuel pressure present within the control chamber 40 is sufficient to move the valve needle 10 against the action of the spring 30 to move the enlarged diameter region 10*a* of the valve needle 10 away from the seating 16. The extent of movement of the valve needle 10 is dependent upon the energization of the actuator 44, and depending upon the magnitude of movement of the needle 10, one or more of the outlet openings 22 may become uncovered thereby permitting fuel to flow from the bore 12 through the drillings 24 and axially extending blind drilling 18 to be delivered to a combustion space of an associated engine through a desired number of the outlet openings 22.

During fuel injection, relatively little leakage of fuel between the needle 10 and the nozzle body 14 occurs. Remote from the seating 16, the fuel present between the needle 10 and the nozzle body is at high pressure and applies relatively large magnitude forces to the needle 19 and nozzle body 14 tending to expand the nozzle body 14 and compress the needle 10. However, the pressure of fuel between the needle 10 and the nozzle body 14 adjacent the seating 16 is relatively low and the fuel pressure within the drilling 18 is sufficiently high to expand the needle 10 to an extent sufficient to limit leakage between the needle 10 and the nozzle body 14 to an acceptable level.

In order to terminate injection, the actuator 44 is returned to its initial energization state thereby permitting movement of the piston member 38 to reduce the fuel pressure within the control chamber 40 to an extent sufficient to allow the valve needle 10 to return to its closed position under the action of the spring 30.

As described hereinbefore, the arrangement illustrated in FIGS. 2 and 3 is advantageous in that the angular orientation of the valve needle 10 relative to the nozzle body 14 remains substantially fixed, in use, thus the orientation of the fuel sprays formed at the outlet openings 22, in use, is fixed. Such an arrangement is particularly advantageous where the fuel injector is mounted in a non-vertical position.

A further advantage is that as, at the commencement of injection, the effective area of the needle 10 exposed to fuel under pressure does not change significantly, the actuator does not need to be able to cope with a sudden change in the load applied thereto by the needle, thus the actuator can be smaller and less costly than in other arrangements.

In the arrangement illustrated in FIGS. 2 and 3, the plug 20 is of simple form, for example taking the form of a simple grub screw. FIGS. 4*a*, 4*b*, 4*c* and 4*d* illustrate arrangements in which the plug 20 is shaped to modify the fuel flow characteristics upstream of the outlet openings 22. In the arrangement illustrated in FIG. 4*a*, the plug 20 includes an integral, axially extending projection 20*a* of cylindrical form which extends to a position upstream of the outlet openings 22. In the arrangement of FIG. 4*b*, the inner end of the plug 20 is shaped to define a recess of part spherical form. The arrangement of FIG. 4*c* is similar to that of FIG. 4*b* but in which the recess is of frusto-conical shape. FIG. 4*d* illustrates an arrangement in which the inner end of the plug 20 is shaped to define a projection of frusto-conical shape. In each case, the shape of the formation or recess provided at the inner end of the plug 20 is shaped to benefit the formation of spray by generating cavitation upstream of the outlet openings 22 or by increasing or decreasing other hydraulic disturbances upstream of the outlet openings 22.

FIG. 5*a* illustrates the lower end of the needle 10, in particular illustrating the enlarged diameter region 10*a* thereof and the plug 20. The manufacturing process involved in machining a needle of this form is relatively complex, and FIGS. 5*b* and 5*c* illustrate modifications to the arrangement of FIG. 5*a* which may be used to simplify the manufacturing process. In the arrangement illustrated in FIG. 5*b*, the enlarged diameter region 10*a* of the needle 10 is of relatively small axial extent, and acts to locate a separate annular abutment member 54, the exposed end surface of which is shaped to sealingly engage the seating 16, in use. The abutment member 54 may be secured to the needle 10 using, for example, a brazing or welding technique, or alternatively the abutment member 54 may be an interference fit with the needle 10. As denoted by the arrows in FIG. 5*b*, the abutment member 54 would be introduced, during assembly, from the end of the needle 10 remote from the enlarged diameter region 10*a* thereof.

FIG. 5*c* illustrates a modification to the arrangement of FIG. 5*b* in which the enlarged diameter region of the needle 10 is omitted, the abutment member 54 being inserted onto the needle 10 from beneath, as denoted by the arrows in FIG. 5*c*.

Although the injector described hereinbefore is intended to be controlled using a piezo electric actuator, it will be appreciated that the invention is also applicable to injectors controlled using other types of control arrangement.

What is claimed is:

1. A fuel injector comprising a valve needle slidable along an axis within a bore formed in a nozzle body, said valve needle including an axially extending fuel supply passage through which fuel is delivered to at least one outlet opening with which said fuel supply passage, communicates, said at least one outlet opening being provided in said valve needle, the supply passage having an end adjacent said at least one outlet opening which is closed by a plug, said plug having an inner end region which is arranged to be located, in use, adjacent said at least one outlet opening, and shaped to modify the flow characteristics of the fuel flow upstream of said at least one outlet opening.

2. The fuel injector as claimed in claim 1, wherein said inner end region of said plug is shaped to define a recess to modify the flow characteristics of the fuel upstream of said at least one outlet opening.

3. The fuel injector as claimed in claim 2, wherein said recess is of part-spherical or conical form.

4. The fuel injector as claimed in claim 1, and further comprising a lock arrangement arranged to prevent angular movement of said valve needle about said axis relative to said nozzle body.

5. The fuel injector as claimed in claim 1, said bore defining a valve seating, said valve needle carrying an annular abutment member which is engageable with said valve seating to control the flow of fuel past said valve seating.

6. The fuel injector as claimed in claim 1, wherein said valve needle, said bore and the outer periphery of said nozzle body have diameters which are chose so as to optimize stress levels within in said nozzle body and said valve needle, thereby restricting the leakage of fuel between said valve needle and said nozzle body to an acceptable level.

7. A fuel injector comprising a valve needle slidable along an axis within a bore formed in a nozzle body, said valve needle including an axially extending fuel supply passage which communicates with at least one outlet opening provided in said valve needle, the supply passage having an end adjacent said at least one outlet opening which is closed by a plug, said plug having an inner end region which is arranged to be located, in use, adjacent said at least one outlet opening, and shaped to modify the flow characteristics of the fuel flow upstream of said at least one outlet opening, said fuel injector further comprising a lock arrangement arranged to restrict angular movement of said valve needle about said axis relative to said nozzle body, wherein said lock arrangement includes a lock member extending within formations provided in said valve needle and the nozzle body.

8. The fuel injector as claimed in claim 7, wherein said lock member takes the form of a pin, said valve needle having an upper end surface and said nozzle body having an upper surface, said formations defining a groove in said upper end surface of said valve needle and a groove in said upper surface of said nozzle body.

9. A fuel injector comprising a valve needle slidable along an axis within a bore formed in a nozzle body, said valve needle including an axially extending fuel supply passage which communicates with at least one outlet opening provided in said valve needle, the supply passage having an end adjacent said at least one outlet opening which is closed by a plug, said plug having an inner end region which is arranged to be located, in use, adjacent said at least one outlet opening, and shaped to modify the flow characteristics of the fuel flow upstream of said at least one outlet opening, the valve needle having an end remote from said at least one outlet opening provided with a screw-thread formation, said screw thread formation cooperating with an annular guide member for guiding movement of said valve needle within said bore, said screw-thread formation having an enlarged root radius to restrict fuel leakage between said valve needle and said guide member.

10. A fuel injector comprising a valve needle slidable along an axis within a bore formed in a nozzle body, said valve needle including an axially extending fuel supply passage which communicates with at least one outlet opening provided in said valve needle, the supply passage having an end adjacent said at least one outlet opening which is closed by a plug, said plug having an inner end region which is arranged to be located, in use, adjacent said at least one outlet opening, and shaped to modify the flow characteristics of the fuel flow upstream of said at least one outlet opening, wherein said plug includes a projection to modify the flow characteristics of the fuel flow upstream of said at least one outlet opening.

11. The fuel injector as claimed in claim 10, wherein said projection is of conical or cylindrical form.

* * * * *